United States Patent [19]

Jacalone et al.

[11] 4,186,846

[45] Feb. 5, 1980

[54] BULK MATERIAL CONTAINER

[75] Inventors: Richard P. Jacalone, Owosso, Mich.; Lewis D. Poggiali, West Chester, Ohio

[73] Assignee: Olinkraft, Inc.

[21] Appl. No.: 1,119

[22] Filed: Jan. 5, 1979

[51] Int. Cl.[2] ..... B65D 1/42; B65D 5/32; B65D 5/48

[52] U.S. Cl. ..... 220/468; 220/441; 229/15; 229/23 R

[58] Field of Search ..... 229/23 R, 15; 220/441, 220/443, 453, 415, 468

[56] References Cited

U.S. PATENT DOCUMENTS

| | | | |
|---|---|---|---|
| 3,066,842 | 12/1962 | Croley | 229/15 X |
| 3,543,991 | 12/1970 | George et al. | 229/15 |
| 3,643,856 | 2/1972 | Jones | 220/441 X |
| 3,701,466 | 10/1972 | Woodrow et al. | 229/15 X |
| 3,715,072 | 2/1973 | Muskopf | 229/15 |
| 3,910,482 | 10/1975 | Bamburg et al. | 220/443 X |
| 3,979,045 | 9/1976 | Bamburg et al. | 229/23 R |
| 4,046,307 | 9/1977 | Booth et al. | 229/15 |

*Primary Examiner*—Allan N. Shoap

*Attorney, Agent, or Firm*—Robert M. Krone; Joseph J. Kelly; Norvell E. Von Behren

[57] ABSTRACT

A bulk material container having two cells laminated together along one of their respective walls to form a double thickness central partition. The abutting juncture of the wall panels of each cell is contained within the central partition and is offset from the juncture of the adjacent cell to increase the strength of the double thickness central partition. Each cell has a reinforcing liner so that the completed bulk container offers double thickness on all the walls and the central partition. A plurality of inwardly folding top flanges and inwardly bottom flaps may be formed on each of the wall panels of the cells of the bulk material container.

8 Claims, 6 Drawing Figures

BULK MATERIAL CONTAINER

BACKGROUND OF THE INVENTION

This invention relates generally to a bulk container that may be used in the packaging of beans or other bulk materials requiring packaging which will withstand stacking pressures and improved resistance to bulging.

Since the user of this type container is concerned with ease of setup of the container, it is customary to ship the flat, knocked-down container to the customer for assembly at the point of use. The container is then stapled or erected by some locking means of the type known in the art and forming no part of the invention.

Stacking strength is another important feature desired by purchasers of these types of containers. Since containers for packaging large quantities of bulk materials are often stacked one on top of another in a warehouse for extended periods of time, it is very important that the container be designed to withstand the pressure of stacking as well as those pressures of bulging created by the products packaged within.

A prior art search of similar bulk material containers in the U.S. Patent and Trademark Office revealed the following U.S. Patents:

| Patent No. | Patentee | Issue Date |
|---|---|---|
| 3,185,379 | Kohlhaas | May 25, 1965 |
| 3,543,991 | George et al. | December 1, 1970 |
| 3,433,401 | Swift | March 18, 1969 |
| 3,276,658 | Locke | October 4, 1966 |
| 3,058,643 | Wilson | October 16, 1962 |
| 3,425,615 | Wood | February 4, 1969 |
| 3,715,072 | Muskopf et al | February 6, 1973 |
| 3,447,733 | Smith et al | June 3, 1969 |
| 3,904,105 | Booth | September 9, 1975 |
| 4,046,307 | Booth et al | September 6, 1977 |

While these patents shown various combinations of reinforcing means utilized in bulk material containers, none of the patents are believed to teach the applicant's new and novel invention. The prior art patents will be briefly discussed in the following paragraphs.

U.S. Pat. No. 3,185,379 issued to Kohlhaas teaches a two cell bulk container having tubular sleeves with single thickness side walls and double thickness end walls. The end walls are formed from inner panel 25 and outer panel 26 which are stitched together at stitch joint 27. Telescoping end closure caps unitize the tubular sleeves.

U.S. Pat. No. 3,543,991 issued to George et al teaches a multi-cell container having quadruple thickness end walls and single thickness side walls. Reinforcing panels 14 on the ends of the container have corrugations extending vertically, and the additional sheet 24 has corrugations extending transversely. The joints are staggered and are not exposed. A rectangular bottom tray encloses the base of the cells and shields the lower portion of the cell side panels.

U.S. Pat. No. 3,433,401 issued to Swift teaches a two cell container having three double thickness vertical walls. Each cell is formed from a five panel sheet, one of the five panels being a reinforcing panel 35 which is arranged in an overlapping relation with the first panel 28 to form one of the double thickness walls with the joint being on an outside corner. The reinforcing panel 35 has an upwardly and outwardly projecting flap. The container has a separate base and a separate cover.

U.S. Pat. No. 3,276,658 issued to Locke teaches a bulk container having a pair of cells placed together in a side-by-side relationship. Each of the four outer corners of the container is provided with a recess 20 for insertion of separate corner posts E. Outer side and end walls are of single thickness. The container A is made up of nine parts. A conventional manufacturer's joint is formed by the glue flap 19 overlapping inner side wall 10 and being secured thereto. Identical bottom caps are provided for each cell along with a single top cap for closing the top of the container.

U.S. Pat. No. 3,058,643 issued to Wilson teaches a two-piece box body having a tray 3 and an outer shell 4 which telescopes over the wall of the tray. End panels 18 and 19 of the shell 4 function as a partition to divide the shell into two compartments 25 and 26. Tongues 31 and 32 provide means for linking the shell 4 and tray 3 together.

U.S. Pat. No. 3,425,615 to Wood teaches a multi-cell container having triple thickness end walls and single thickness side walls. The inner end wall is secured to the intermediate tube 11 to give double thickness along that wall.

U.S. Pat. No. 3,715,072 issued to Muskopf et al teaches a multi-cell box reinforced by connecting sheet 19 having adhesive applied to both sides to join the cells together. Each cell has partial end wall panels 6 and 7 which are positioned with their edges adjacent each other to form substantially an abutment joint 14. The abutment joints are offset from each other. Reinforcing pads 19 are also on the end walls along with additional reinforcing pad 22. The container has quadruple thickness end walls, triple thickness walls between the cells, double thickness side walls, and an external manufacturer's joint.

U.S. Pat. No. 3,447,733 teaches a shipping case having a pair of adhesively or otherwise removably interconnected sections. Each section has a ripcord to permit easy opening of the section. The bottoms of the sections may be used as trays. This container is not designed for the shipping of heavy bulk materials.

U.S. Pat. No. 3,904,105 issued to Booth teaches an open ended multi-cell body having top and bottom caps and external manufacturer's joints 56 and 56'. Each cell has a three-sided liner laminated to a four-sided sleeve. Bottom dispensing means are provided in the bottom cap by means of a pull plate 20.

U.S. Pat. No. 4,046,307 issued to Booth et al teaches a two cell bulk container including a pair of sleeves formed from four hingedly connected panels and having an inside joint flap formed on one of the end panels and an outside joint flap formed on the other of the end panels. The cells are bonded together so that the outside joint flap of each cell is secured to a wall panel of the adjacent cell to form a bridge. The three-piece liner for each cell has top flaps. Crushed areas 96, 96', 98, and 98' in the liners and sleeves aid in folding the container.

SUMMARY OF THE INVENTION

In order to overcome many of the problems encountered with the prior art containers and to provide an improved bulk container, there has been provided by the subject invention a bulk container which would have improved stacking strength and improved bulge resistance.

Each cell of the improved bulk container is formed from a series of five hingedly connected wall panels and each wall panel may also have a top flange and a bottom flap. In the erection of a cell, the edges of the outermost wall panels, which are partition panels, in the series of five panels abut to form a juncture or joint. After the cells have been formed, they are then laminated together in a face-to-face relationship along their respective walls containing the junctures to form a double-thickness central partition. To add greater strength and stability to the central partition, the juncture of the first cell is offset or staggered from the juncture of the second cell. Each cell is further strengthened by means of a reinforcing liner formed from a series of three hingedly connected wall panels. The reinforcing liners are laminated in the preferred embodiment to the inside of the second, third and fourth outer wall panels of the first cell and to the inside of the seventh, eighth and ninth outer panels of the second cell. However, if desired, the reinforcing liners could be laminated to the outside of these same outer wall panels as shown by the drawings. Thereby the container is provided with double thickness side and end walls in addition to the double thickness central partition.

Additional strength may be afforded the walls of each cell, including the wall forming the central partition, by means of top flanges and bottom flaps formed on each of the walls panels. The top flanges and bottom flaps of each cell fold inwardly of the side walls of their respective cells.

It is an object and advantage of the invention to provide an improved bulk material container which can be easily assembled at the point of use.

A further object and advantage of the applicant's invention is to provide a bulk material container having double thickness walls and a double thickness central partition to offer improved stacking strength and bulge resistance.

Another object of the invention is the addition of top flanges and bottom flaps folding inwardly of each cell to further increase the structural stability of the cell walls.

Still another object of the invention is the elimination of the conventional manufacturer's joint on the walls of the container.

These and other objects and advantages of the invention will become apparent from a review of the drawings accompanying this application, as well as a study of the preferred embodiment to be described more fully hereinafter.

DESCRIPTION OF THE PREFERRED EMBODIMENT

Figure 1:
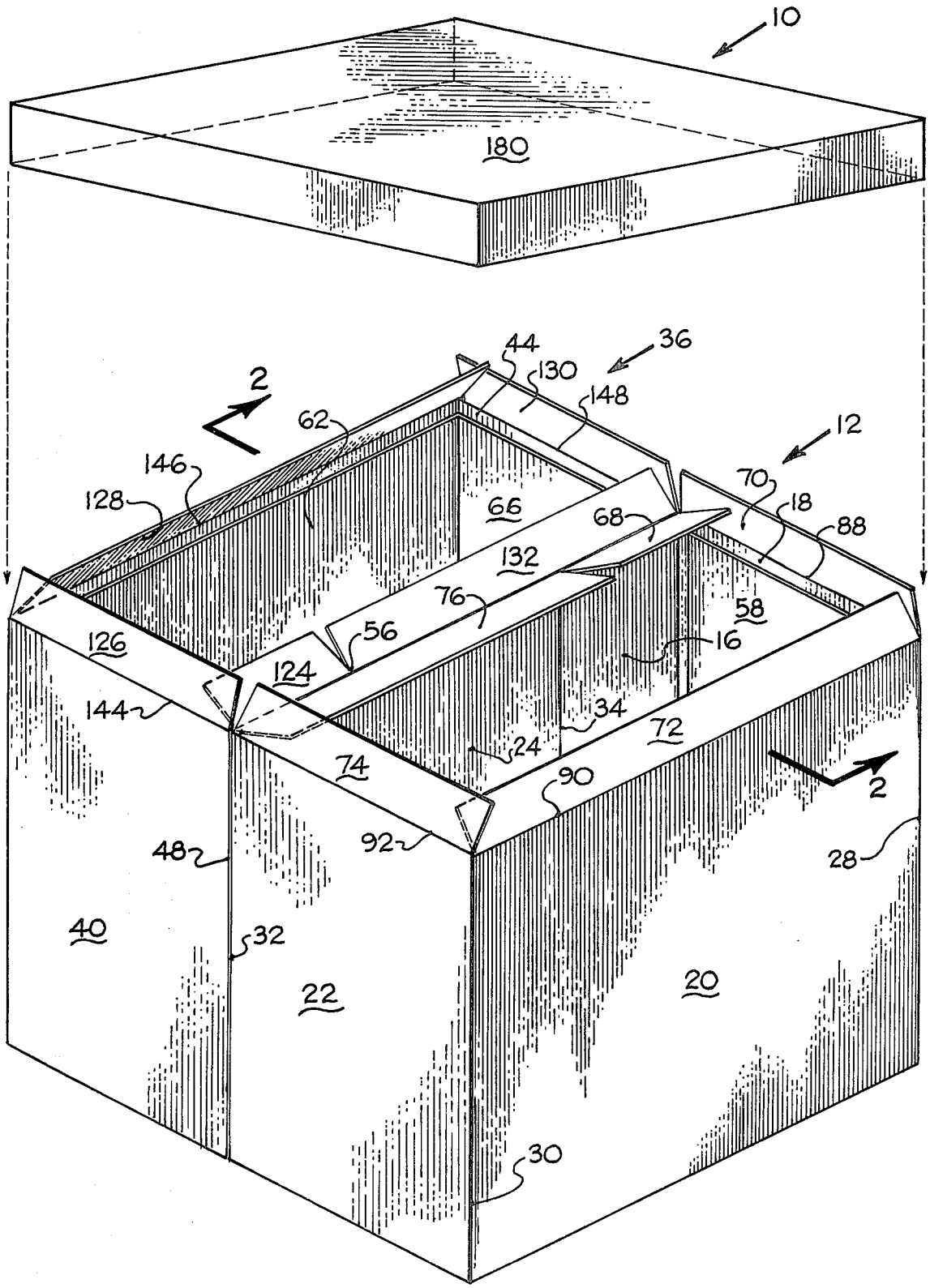
FIG. 1 is an exploded perspective view of the subject new and novel bulk material container showing the first and second cells laminated together and a top cap ready for positioning on the bulk material container.

Referring now to the drawings in general and in particular to FIG. 1 of the drawing, there is shown the new and novel bulk material container of the subject invention generally by the numeral 10 comprising a first cell shown generally by the numeral 12 and a second cell shown generally by the numeral 36. In the preferred embodiment the first cell 12 and the second cell 36 are laminated together along one of their respective walls to form a double thickness central partition 57 as will be more fully described hereinafter when referring to FIG. 2. Each cell has a reinforcing liner 14 as shown in FIG. 3 so that the completed bulk container 10 offers double thickness protection on all the walls and the central partition 57.

Figure 4:
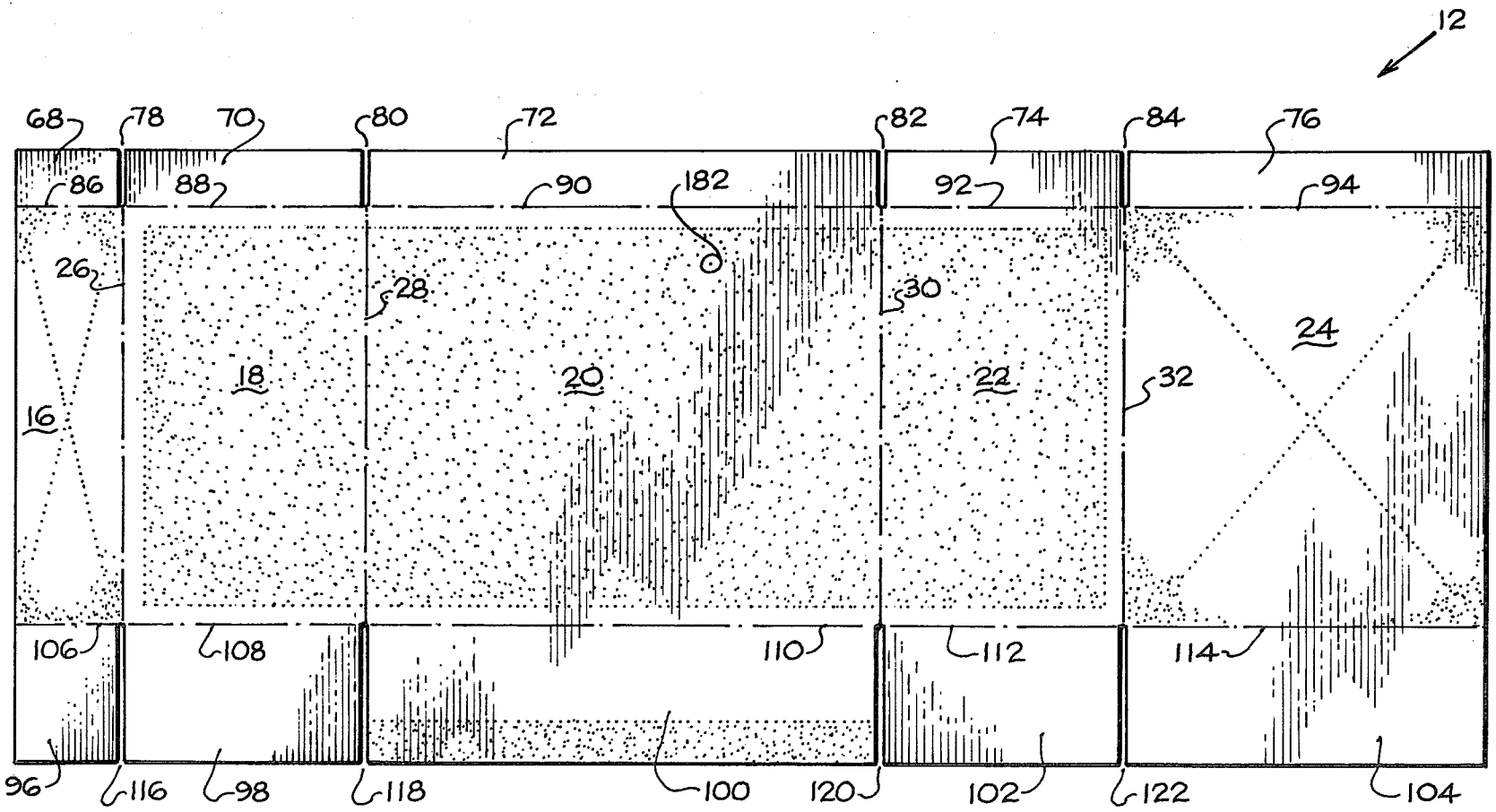
FIG. 4 is a plan view of the production blank for the first cell of the bulk material container, the production blank for the second cell being an identical configuration to that of the first cell.

By referring to FIG. 4 of the drawings there can be seen a production blank for forming the first cell 12 of the bulk material container. The production blank comprises a series of five hingedly connected panels consisting of a first partition pane 16, a second outer wall panel 18, a third outer wall panel 20, a fourth outer wall panel 22 and a fifth partition panel 24. The panels 16, 18, 20, 22 and 24 are hingedly connected by means of a plurality of scorelines 26, 28, 30 and 32.

Top flanges 68, 70, 72, 74 and 76 may be hingedly connected to one end of the panels 16, 18, 20, 22 and 24 by means of the scorelines 86, 88, 90, 92 and 94 respectively. Cutouts 78, 80, 82 and 84 are formed between the top flanges 68, 70, 72, 74 and 76 and extend the depth of the top flanges.

A plurality of bottom flaps 96, 98, 100, 102, and 104 may be formed on the opposite end of panels 16, 18, 20, 22 and 24 of the first cell 12 and are hingedly connected thereto by means of the scorelines 106, 108, 110, 112 and 114 respectively. Cutouts 116, 118, 120 and 122 are formed between the bottom flaps 96, 98, 100, 102 and 104 respectively and extend the depth of the bottom flaps.

Although not pictured as a separate drawing of the production blank, the second cell 36 is formed from a blank which is identical to that of the first cell 12 shown in FIG. 4 of the drawings. By referring to FIG. 5 there is shown the blank for forming the second cell 36 which comprises a series of five hingedly connected panels consisting of a sixth partition panel 38, a seventh outer wall panel 40, an eighth outer wall panel 42, a ninth outer wall panel 44 and a tenth partition panel 46. The panels 38, 40, 42, 44 and 46 are hingedly connected by means of a plurality of scorelines 48, 50, 52 and 54.

Top flanges 124, 126, 128, 130 and 132 may be hingedly connected to one end of the wall panels 38, 40, 42, 44 and 46 of the second cell 36 by means of the scorelines 142, 144, 146, 148 and 150 respectively. Cutouts 134, 136, 138 and 140 are formed between the top flanges 124, 126, 128, 130 and 132 and extend the depth of the top flanges.

A plurality of bottom flaps 152, 154, 156, 158 and 160 may be formed on the opposite end of panels 38, 40, 42, 44 and 46 and are hingedly connected thereto by means of the scorelines 162, 164, 166, 168 and 170. Cutouts 172, 174, 176, and 178 are formed between the bottom flaps 152, 154, 156, 158 and 160 respectively and extend the depth of the bottom flaps. The bottom flaps of the second cell 36 would be formed and located similarly to the bottom flaps of the first cell 12 and have not been shown in the drawing figures for purpose of clarity and to eliminate unnecessary views.

By referring to FIG. 3 of the drawings there can be seen a production blank for the reinforcing liners indicated by the numeral 14. The reinforcing liner comprises a first liner wall panel 58 hingedly connected to a second liner wall panel 62 by means of the scoreline 60, and a third liner wall panel 66 is hingedly connected on the opposite side of the second liner wall panel 62 by means of the scoreline 64. Prior to erection of the first cell 12 of the bulk material container, the liner wall panels 58, 62 and 66 are adhesively secured by means of the glue 182 to the inside of the second outer wall panel 18, third outer wall panel 20 and fourth outer wall panel 22 of the first cell 12. In a similar manner, an identical reinforcing liner 14 is adhesively secured to the seventh outer wall panel 40, the eighth outer wall panel 42 and the ninth outer wall panel 44 of the second cell 36 by means of the glue 182. FIG. 4 shows the position of the glue 182 which is shown by stippling in the figure.

Figure 5:
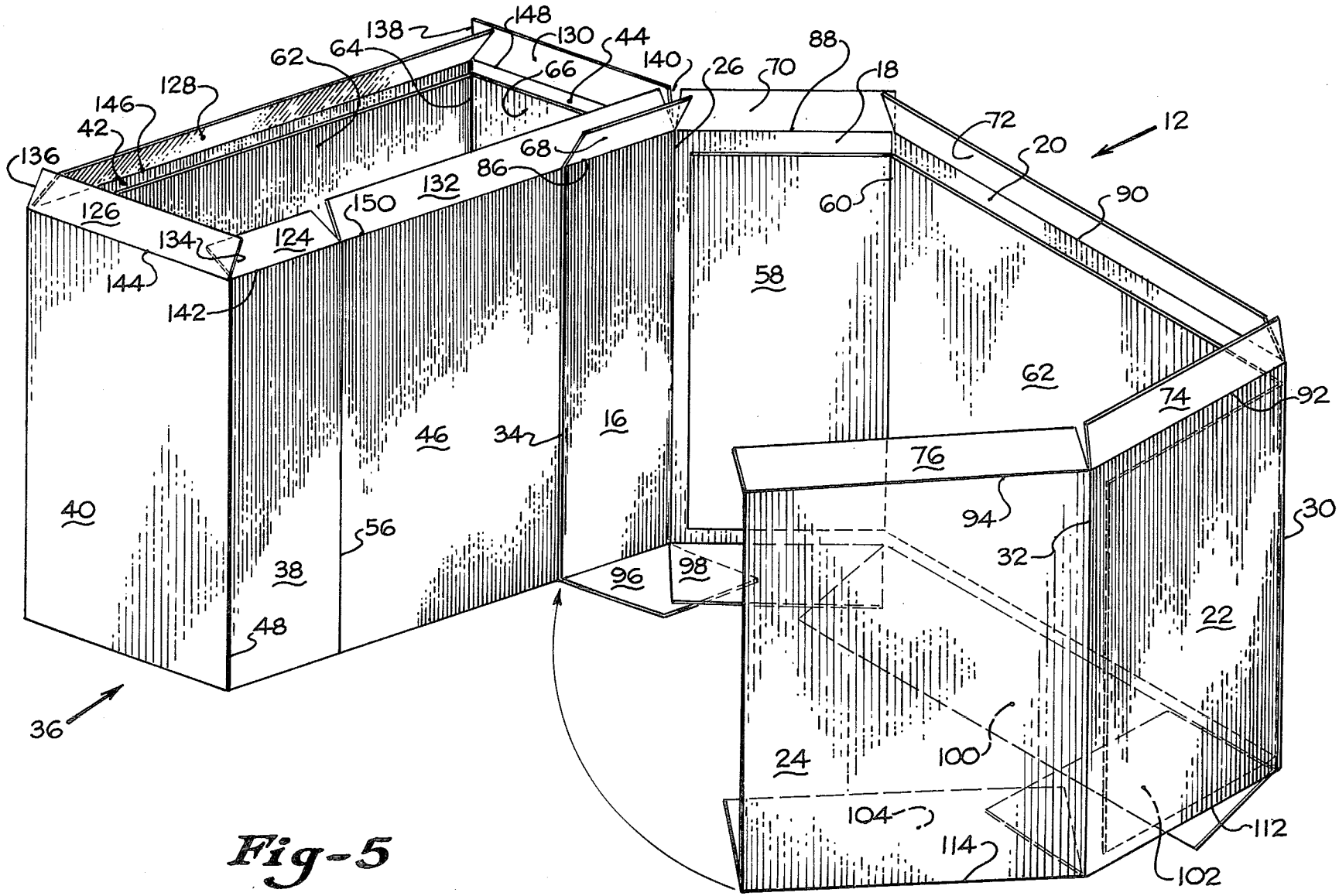
FIG. 5 is a perspective view showing one of the cells of the container fully erected and the other cell being folded into its final configuration.

Referring to FIG. 5 of the drawings the assembly of the cells 12 and 36 will be discussed hereinafter. In order to assemble the first cell 12 of the bulk container 10, the panels 16, 18, 20, 22 and 24 are folded about their scorelines 26, 28, 30 and 32 while the inner reinforcing liner 14, which has been adhesively secured to outer wall panels 18, 20 and 22, is folded about its scorelines 60 and 64. A juncture 34 is formed by the outer edge of the first partition panel 16 abutting the outer edge of fifth partition panel 24. The first partition panel 16 and fifth partition panel 24 form one of the walls of the double thickness central partition 57.

The second cell 36 of the bulk material container 10 is assembled in a like manner to the first cell 12. The panels 38, 40, 42, 44 and 46 are folded about their scorelines 48, 50, 52 and 54 while the reinforcing liner, which has been adhesively secured to the outer wall panels 40, 42 and 44, is folded about its scorelines 60 and 64. A juncture 56 is formed by the outer edge of the sixth partition panel 38 abutting the outer edge of tenth partition panel 46. The sixth partition panel 38 and tenth partition panel 46 form the other wall of the double thickness central partition 57.

Figure 2:
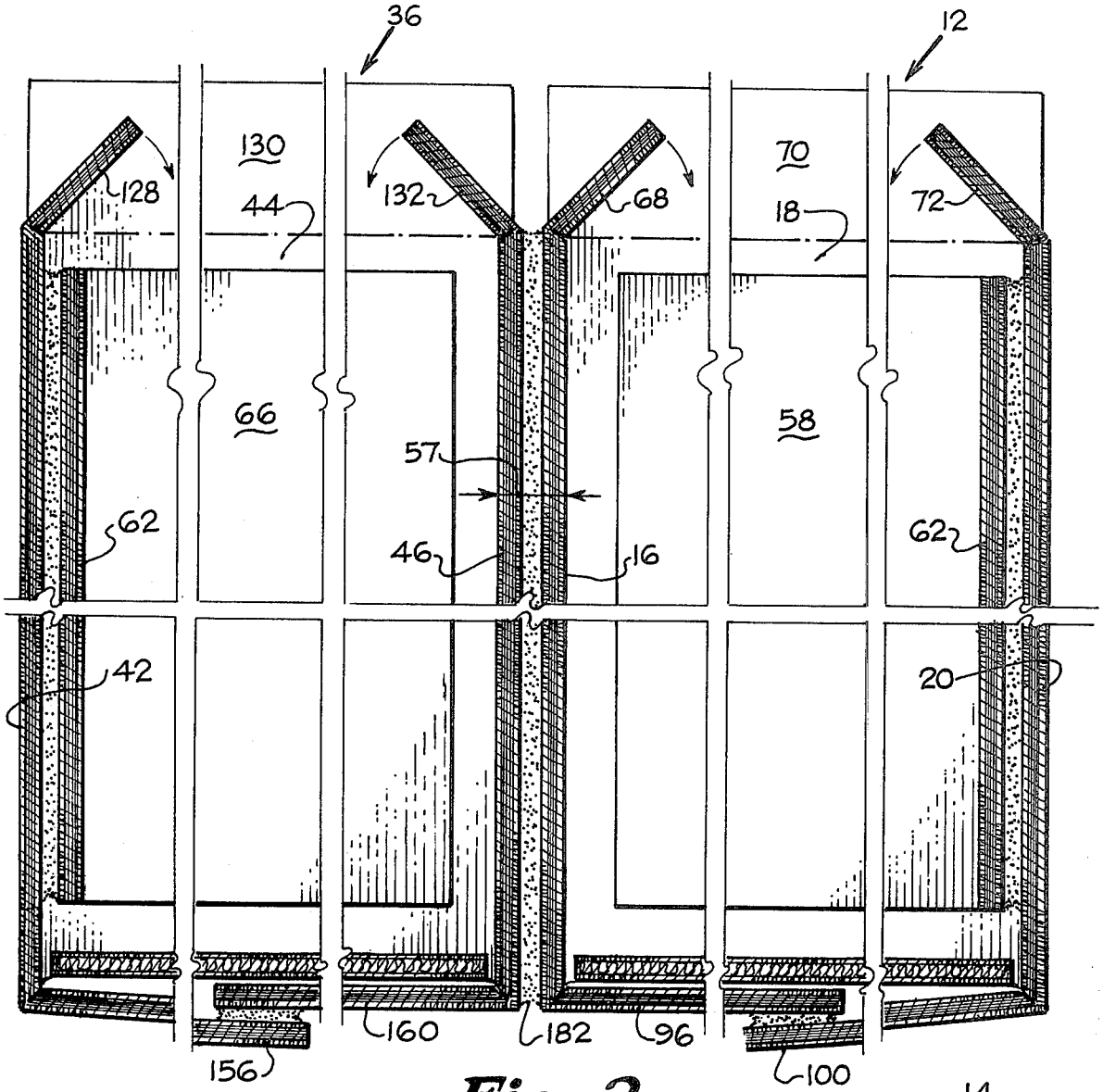
FIG. 2 is an enlarged sectional view, taken along line 2—2 of FIG. 1 showing the two cells laminated together and further showing the folding sequence of the top flanges and bottom flaps prior to positioning of the top cap.
Figure 3:
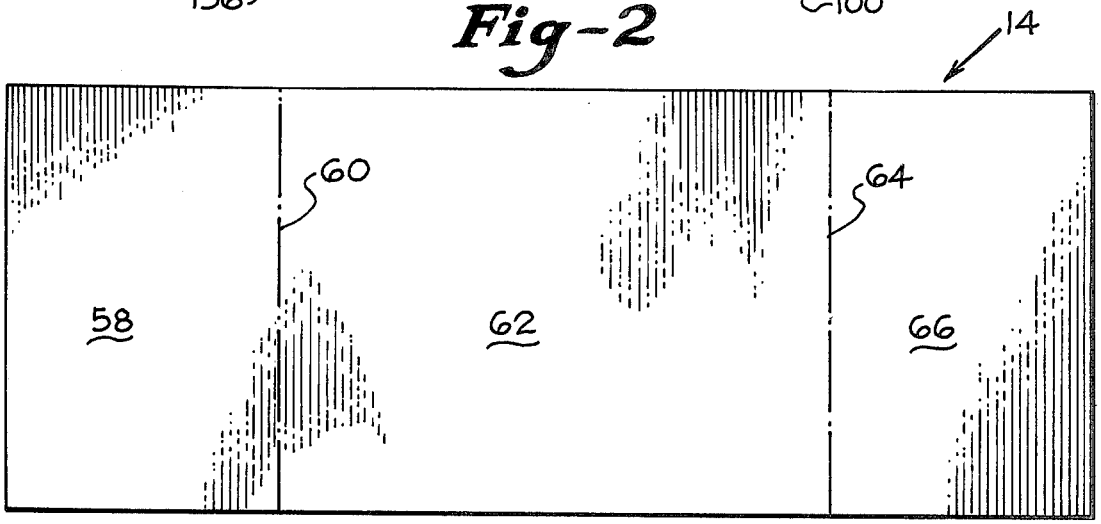
FIG. 3 is a plan view of the production blank for the reinforcing liners for the bulk material container.
Figure 6:
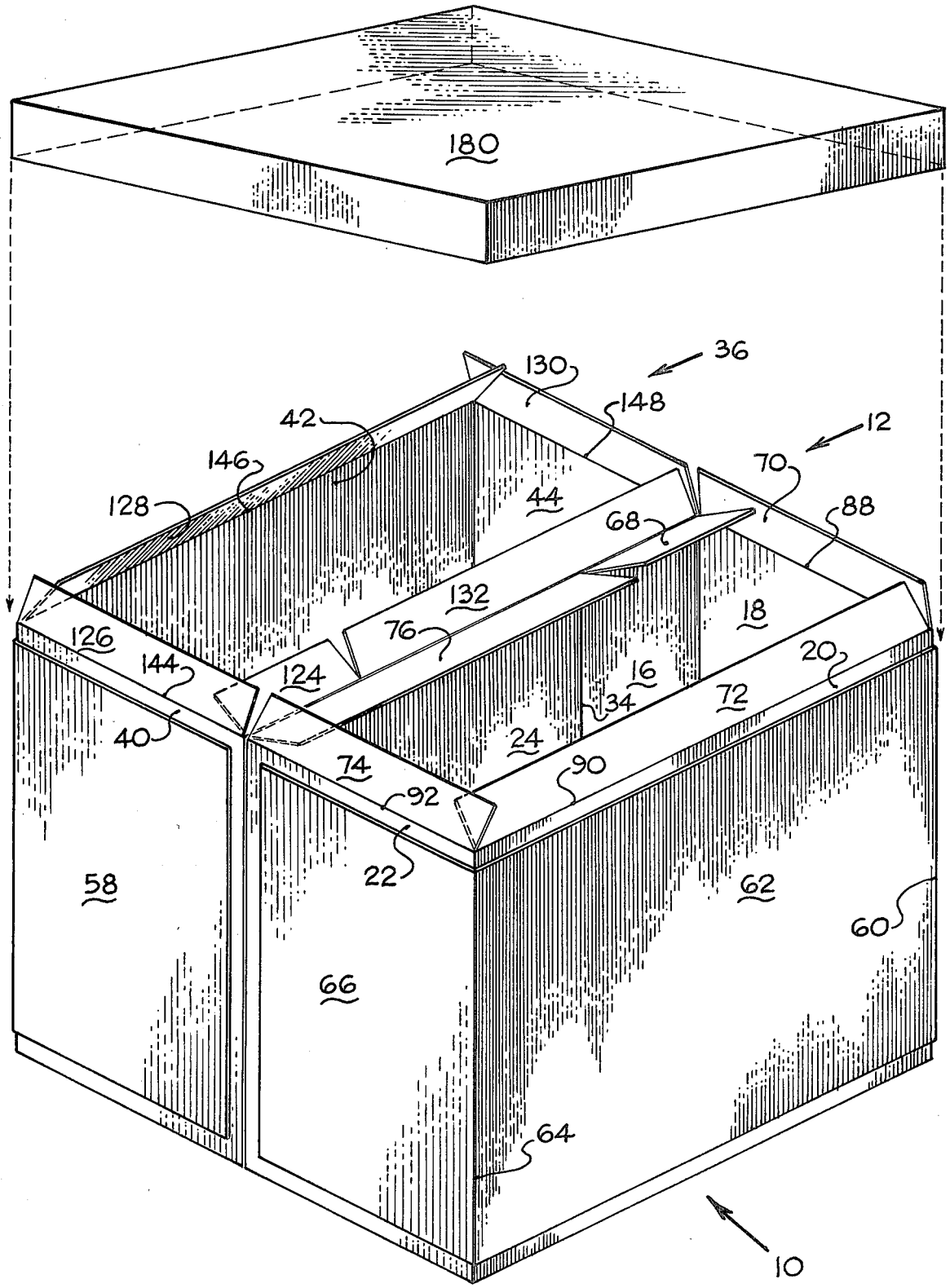
FIG. 6 is an exploded perspective view of an alternative embodiment of the bulk material container with the reinforcing liners laminated to the outside wall panels of the cells.

As shown in FIGS. 1, 2 and 6 of the drawings, the first cell 12 and second cell 36 are adhesively secured along their respective walls forming the double thickness central partition 57 in such a manner that the juncture 34 of the first cell 12 is offset from the juncture 56 of the second cell 36 a predetermined distance so that the first partition panel 16 of the first cell 12 is laminated to a portion of the tenth partition panel 46 of the second cell 36, and the sixth partition panel 38 of the second cell 36 is laminated to a portion of the fifth partition panel 24 of the first cell 12. The remaining portions of the fifth partition panel 24 and tenth partition panel 46 are also laminated together to complete the formation of the central partition 57 of the bulk material container 10. If utilized, the top flanges 68, 70, 72, 74 and 76 are folded inwardly of the first cell 12 about their respective scorelines 86, 88, 90, 92 and 94. In a like manner the top flanges 124, 126, 128, 130 and 132 would be folded inwardly of the second cell 36 about their respective scorelines 142, 144, 146, 148 and 150. In the embodiment shown the top flanges cover only a portion of the top of the cells; however, the size of the flanges could vary according to the desires of the customer or the goods to be packaged within the container. In the preferred embodiment a top cap 180 is utilized to cover the top of the bulk container 10.

If utilized the bottom flaps 96, 98, 100, 102 and 104 of the first cell 12 would be folded inwardly about their respective scorelines 106, 108, 110, 112 and 114 and are sized to provide a bottom for the first cell 12. In a like manner, the bottom flaps 152, 154, 156, 158 and 160 of the second cell 36 are folded inwardly about their respective scorelines 162, 164, 166, 168 and 170 and are sized to provide a bottom for the second cell 36. While in the embodiment shown the bottom flaps are sized to provide a bottom for the cells, it is within the spirit and scope of the invention that other means may be utilized to provide a bottom or to add greater strength to the bottom such as a slip sheet or bottom cap.

The combination of the top flanges and bottom flaps together with the offset junctures may be used to add greater strength and stability to the double thickness central partition 57. In addition, the reinforcing liners 14 in the cells 12 and 36 which give double thickness to the remaining walls of the container provide a bulk container which is strong and stable. The elimination of the conventional manufacturer's joint offers a smooth perimeter surface which eliminates snagging against adjacent containers.

Referring to FIG. 6 of the drawings, there is shown an alternate embodiment of the bulk material container 10 wherein the reinforcing liners 14 are laminated to the outside of the wall panels of the cells 12 and 36. The remaining features of the alternate embodiment of FIG. 6 would be similar to the features shown in the embodiment of FIGS. 1–5.

From the foregoing it can be seen that there has been provided by the subject invention a new and improved bulk material container which would have improved stacking strength and bulge resistance. It may become apparent from the specification and drawings that many changes and modifications may be made in the basic invention within the spirit and scope of the invention and the preferred embodiment, and modifications described herein have been given by way of illustration only.

Having described our invention, we claim:

1. A bulk material container having two cells laminated together along one of their respective walls to form a double thickness center partition, said container also being formed with double thickness side and end walls having no external manufacturer's joint, the container comprising:

(a) a first cell formed from a series of hingedly connected wall panels consisting of a first partition panel, a second outer wall panel, a third outer wall panel, a fourth outer wall panel, and a fifth partition panel;

(b) a second cell formed from a series of hingedly connected wall panels consisting of a sixth partition panel, a seventh outer wall panel, and eighth outer wall panel, a ninth outer wall panel, and a tenth partition panel;

(c) a pair of reinforcing liners, each liner being formed from a series of three hingedly connected wall panels, one of said liners being laminated to the second, third, and fourth outer panels of the first cell and the other of said liners being laminated to the seventh, eighth, and ninth outer panels of the second cell;

(d) a double thickness central partition formed by an edge of said first and fifth partition panels of said first cell abutting to form a juncture and an edge of said sixth and tenth partition panels of said second cell abutting to form a juncture, the junctures being offset a pre-determined distance so that the first partition panel of said first cell is laminated to a portion of said tenth partition panel of said second cell and the sixth partition panel of said second cell is laminated to a portion of the fifth partition panel of the first cell, the remaining portions of the fifth and tenth partition panels also being laminated together to complete the formation of the central partition of the bulk material container.

2. The bulk material container as described in claim 1 wherein said wall panels of said first and second cells having hingedly connected thereto a plurality of top flanges which fold inwardly from the sides of each of the cells.

3. The bulk material container as described in claim 2 wherein said top flanges are folded inwardly and enclose a portion of the top of the container.

4. The bulk material container as described in claim 1 wherein said wall panels of said first and second cells have hingedly connected thereto a plurality of bottom flaps which fold inwardly from the sides of each of the cells.

5. The bulk material container as described in claim 4 wherein the bottom flaps are folded inwardly and form a bottom for the container.

6. The bulk material container as described in claim 1 wherein a top cap is provided to enclose the top of the container.

7. The bulk material container as described in claim 1 wherein said reinforcing liners are laminated to the inside of the outer wall panels of each of the cells.

8. The bulk material container as described in claim 1 wherein said reinforcing liners are laminated to the outside of the outer wall panels of each of the cells.

* * * * *

Disclaimer 4,186,846.—*Richard P. Jacalone*, Owosso, Mich., and *Lewis D. Poggiali*, West Chester, Ohio. BULK MATERIAL CONTAINER. Patent dated Feb. 5, 1980. Disclaimer filed Feb. 15, 1980, by the assignee, *Olinkraft, Inc.*

Hereby enters this disclaimer to all of the claims of said patent.

[*Official Gazette, April 29, 1980.*]